US009959958B1

(12) United States Patent
Chen et al.

(10) Patent No.: US 9,959,958 B1
(45) Date of Patent: May 1, 2018

(54) PTC CIRCUIT PROTECTION DEVICE AND METHOD OF MAKING THE SAME

(71) Applicant: FUZETEC TECHNOLOGY CO., LTD., New Taipei (TW)

(72) Inventors: Jack Jih-Sang Chen, New Taipei (TW); Chang-Hung Jiang, New Taipei (TW)

(73) Assignee: FUZETEC TECHNOLOGY CO., LTD., New Taipei (TW)

( * ) Notice: Subject to any disclaimer, the term of this patent is extended or adjusted under 35 U.S.C. 154(b) by 0 days. days.

(21) Appl. No.: 15/666,422

(22) Filed: Aug. 1, 2017

(51) Int. Cl.

| | |
|---|---|
| ***H01C 7/10*** | (2006.01) |
| ***H01C 7/02*** | (2006.01) |
| ***H01C 1/14*** | (2006.01) |
| ***H01C 17/00*** | (2006.01) |

(52) U.S. Cl.
CPC ..... *H01C 7/021* (2013.01); *H01C 1/1406* (2013.01); *H01C 7/028* (2013.01); *H01C 17/00* (2013.01)

(58) Field of Classification Search
CPC ..... H01C 7/021; H01C 1/1406; H01C 7/028; H01C 17/00
USPC ..... 338/22 R, 13
See application file for complete search history.

(56) References Cited

U.S. PATENT DOCUMENTS

| | | | | |
|---|---|---|---|---|
| 6,640,420 | B1 * | 11/2003 | Hetherton | H01C 1/1406 29/612 |
| 7,532,101 | B2 * | 5/2009 | Suzuki | H01C 1/1406 337/161 |
| 2001/0000658 | A1 * | 5/2001 | Barrett | H01C 7/021 338/22 R |
| 2002/0125982 | A1 * | 9/2002 | Swensen | H01C 1/14 338/22 R |
| 2002/0130757 | A1 * | 9/2002 | Huang | H01C 1/1406 338/22 R |
| 2006/0132277 | A1 * | 6/2006 | Hetherton | H01C 1/1406 336/232 |
| 2009/0174521 | A1 * | 7/2009 | Ihle | H01C 1/014 338/25 |
| 2015/0029630 | A1 * | 1/2015 | Usui | H01C 7/021 361/103 |

* cited by examiner

*Primary Examiner* — Kyung Lee
(74) *Attorney, Agent, or Firm* — Christensen O'Connor Johnson Kindness PLLC

(57) ABSTRACT

A PTC circuit protection device, includes: two PTC units, each of the PTC units including a first insulating layer, a first electrically conductive layer, a PTC polymeric layer, a second electrically conductive layer, a second insulating layer, a first electrode, a second electrode; an insulating bridge layer interconnecting the first insulating layers of the PTC units; and first and second gaps formed between the PTC units and located at two opposite sides of the insulating bridge layer.

13 Claims, 9 Drawing Sheets

PTC CIRCUIT PROTECTION DEVICE AND METHOD OF MAKING THE SAME

FIELD

This disclosure relates to a PTC circuit protection device and a method of making the same, more particularly to a surface-mounted PTC circuit protection device and a method of making the same.

BACKGROUND

A positive temperature coefficient (PTC) component exhibits a PTC effect that renders the same to be useful as a PTC circuit protection device, such as a fuse. The PTC component includes a PTC polymeric material unit and first and second electrodes formed on two opposite surfaces of the PTC polymeric material unit. The PTC polymer material unit includes a polymer matrix that contains a crystalline region and a non-crystalline region, and a particulate conductive filler that is dispersed in the non-crystalline region of the polymer matrix and that is formed into a continuous conductive path for electrical conduction between the first and second electrodes. The PTC effect is a phenomenon that occurs when the temperature of the polymer matrix is raised to its melting point, in which crystals in the crystalline region start melting, resulting in generation of a new non-crystalline region. As the new non-crystalline region is increased to an extent to merge into the original non-crystalline region, the conductive path of the particulate conductive filler will become discontinuous and the resistance of the PTC polymer material will be sharply increased, thereby resulting in an electrical disconnection between the first and second electrodes.

Referring to FIG. 1, a conventional surface-mounted PTC circuit protection device 1 includes a PTC component 14, a first insulation layer 15, a second insulation layer 16, a first electrode 17 and a second electrode 18. The PTC component 14 includes a first electrically conductive member 12, a second electrically conductive member 13 and a polymeric material layer 11 laminated therebetween. The polymeric material layer 11 exhibits PTC behavior and includes a polymer matrix and a particulate conductive filler dispersed in the polymer matrix.

The first insulation layer 15 is disposed on the first electrically conductive member 12, whereas the second insulation layer 16 is disposed on the second electrically conductive member 13. The first electrode 17 is electrically coupled to the first electrically conductive member 12, and is disposed on the first insulation layer 15 and further extends toward the second insulation layer 16. Likewise, a second electrode 18 is electrically coupled to the second electrically conductive member 13, and is disposed on the second insulation layer 16 and further extends toward the first insulation layer 15.

The conventional surface-mounted PTC circuit protection device is usually installed in an electronic equipment. The PTC circuit protection device may be tripped to its high resistance state when the working current of the electronic equipment reaches the trip current of the PTC circuit protection device. The electronic equipment cannot be used until the PTC circuit protection device is reset or returned to its lower resistance state.

SUMMARY

Therefore, an object of the present disclosure is to provide a PTC circuit protection device and a method of making the same that can overcome at least one of the aforesaid drawbacks associated with the prior art.

According to one aspect of this disclosure, there is provided a PTC circuit protection device that includes:

two PTC units, each of the PTC units including a first insulating layer, a first electrically conductive layer stacked on the first insulating layer, a PTC polymeric layer stacked on the first electrically conductive layer, a second electrically conductive layer stacked on the PTC polymeric layer, a second insulating layer stacked on the second electrically conductive layer, a first electrode electrically connected to the first electrically conductive layer and electrically insulated from the second electrically conductive layer, a second electrode electrically connected to the second electrically conductive layer and electrically insulated from the first electrically conductive layer;

an insulating bridge layer interconnecting the first insulating layers of the PTC units;

first and second gaps formed between the PTC units and located at two opposite sides of the insulating bridge layer.

According to another aspect of this disclosure, there is provided a method of making a PTC circuit protection device. The method includes:

providing a PTC component that includes a first electrically conductive unit, a second electrically conductive unit and a PTC polymeric material unit sandwiched between the first and second electrically conductive units, disposing a first insulating unit on the first electrically conductive unit of the PTC component, and disposing a second insulating unit on the second electrically conductive unit of the PTC component;

disposing a lower electrode component on the first insulating unit oppositely of the PTC component;

disposing an upper electrode component on the second insulating unit oppositely of the PTC component;

hot pressing the PTC component, the first and second insulating units, and the lower and upper electrode components, wherein the PTC component, the second insulating unit and the upper electrode component constitutes a laminate body;

forming a first gap in the lower electrode component such that the lower electrode component is divided into two separated lower electrode units, and forming a second gap in the laminate body such that the laminate body is divided into two separated laminating units, so as to form two PTC units which are interconnected by the first insulating layer and each of which includes one of the lower electrode units and one of the laminating units.

BRIEF DESCRIPTION OF THE DRAWINGS

Other features and advantages of the disclosure will become apparent in the following detailed description of the embodiment with reference to the accompanying drawing, of which.

DETAILED DESCRIPTION

Figure 1:
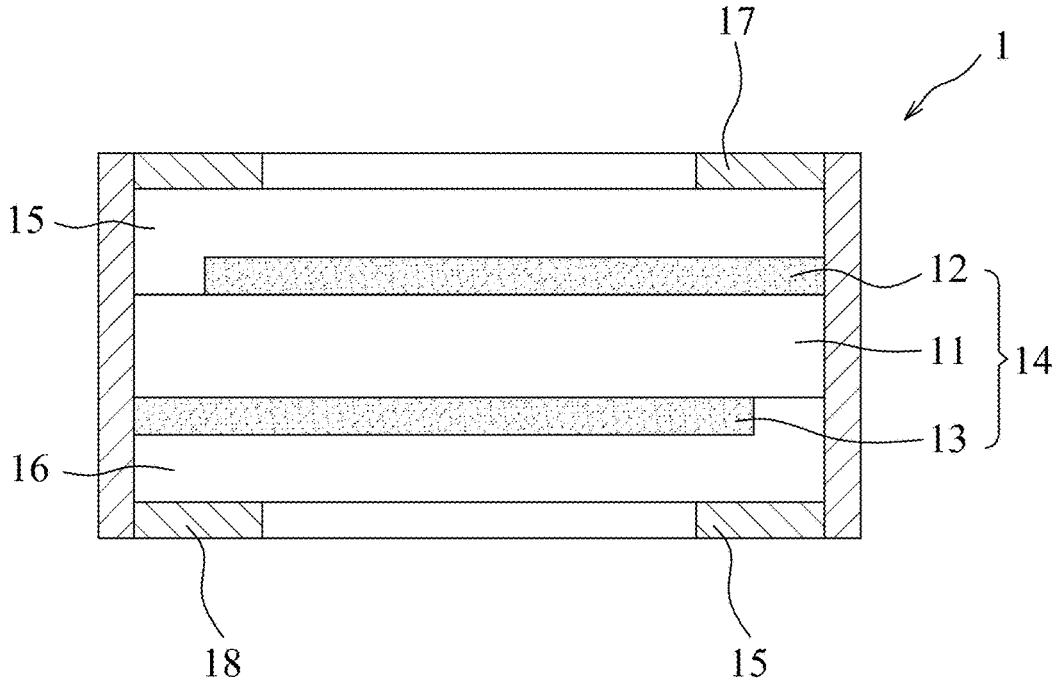
FIG.1 PRIOR ART
FIG. 1 is a schematic view to illustrate a conventional PTC circuit protection device.

Before the present disclosure is described in greater detail with reference to the accompanying embodiments, it should be noted herein that like elements are denoted by the same reference numerals throughout the disclosure.

Referring to FIGS. 2 to 9, the first embodiment of a method of manufacturing a PTC circuit protection device includes the following steps S1-S8.

Figure 2:
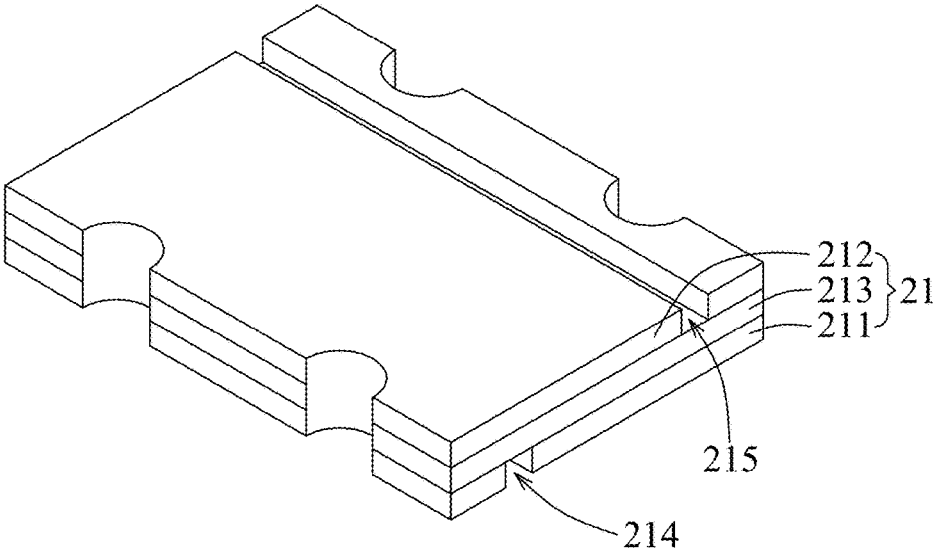
FIGS. 2 to 9 are perspective views to illustrate consecutive steps of the first embodiment of a method of making a PTC circuit protection device according to this disclosure.

In Step S1, referring to FIG. 2, a PTC component 21 including a first electrically conductive unit 211, a second electrically conductive unit 212 and a PTC polymeric material unit 213 sandwiched between the first and second electrically conductive units 211, 212 is provided. In this embodiment, each of the first electrically conductive unit 211 and the second electrically conductive unit 212 is nickel clad copper foil.

In this embodiment, each of the first and second electrically conductive units 211, 212 is formed by respectively disposing first and second conductive films on upper and lower surfaces of the PTC polymeric material unit 213, and forming a groove 214, 215 in each of the first and second conductive films by a method, e.g., laser trimming or chemical etching, such that the PTC polymeric material unit 213 is exposed from the groove 214, 215 and each of the first and second conductive films is divided into two separated portions. As shown in FIG. 2, in this embodiment, the portion of the first conductive film at the right side of the groove 214 is the first electrically conductive unit 211, and the portion of the second conductive layer at the left side of the groove 215 is the second electrically conductive unit 212.

Figure 3:
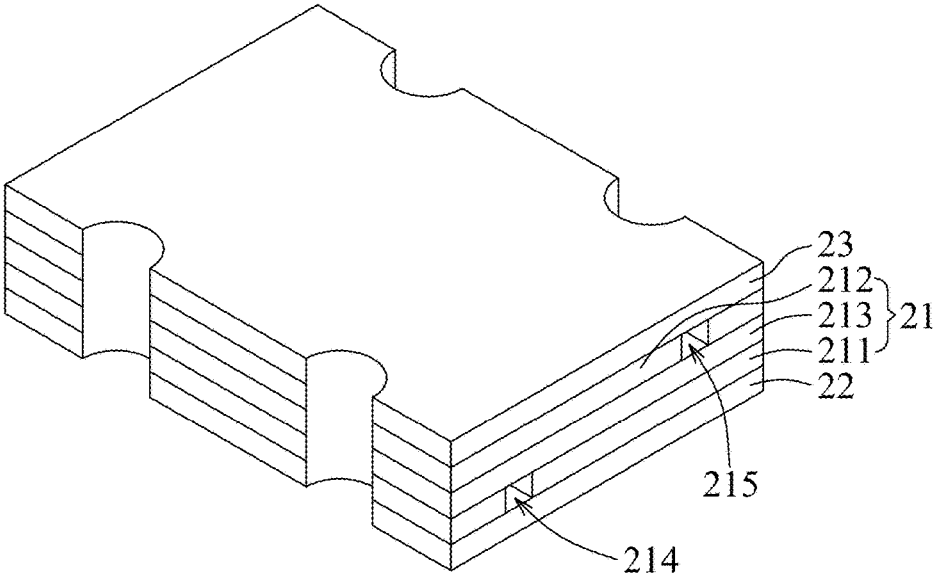

In Step S2, referring to FIG. 3, a first insulating unit 22 is disposed on the first electrically conductive unit 211 of the PTC component 21, and a second insulating unit 23 is disposed on the second electrically conductive unit 212 of the PTC component 21. In this embodiment, each of the first insulating unit 22 and the second insulating unit 23 is made from epoxy resin. In this embodiment, the first insulating unit 22 is also formed on a portion of the first conductive film at the left side of the groove 214, and the second insulating unit 23 is also formed on a portion of the first conductive film at the right side of the groove 215.

Figure 4:
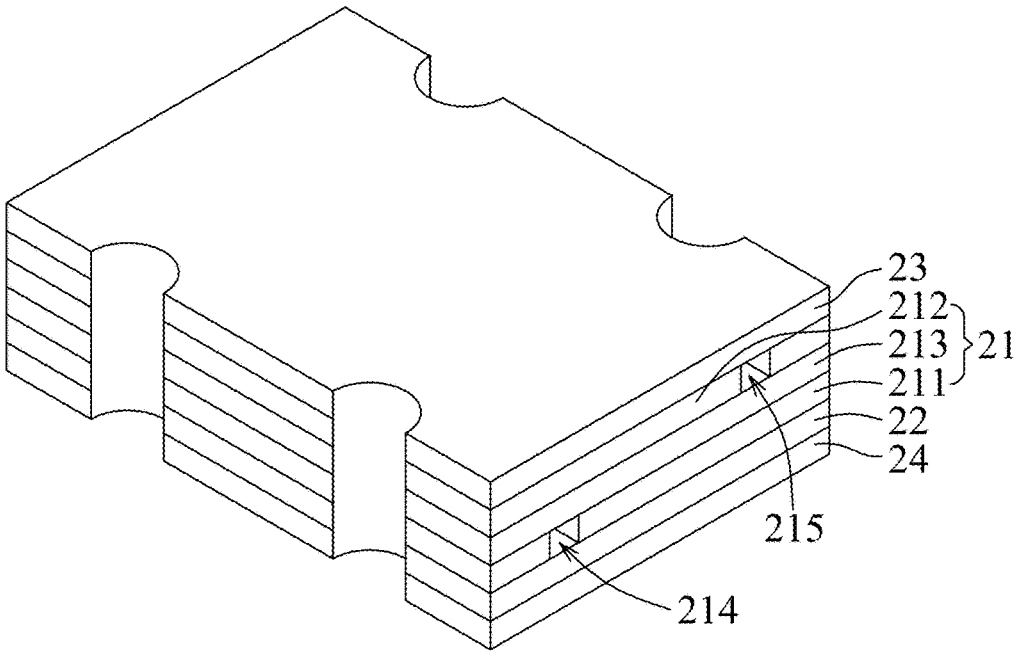

In Step S3, referring to FIG. 4, a lower electrode component 24 is disposed on the first insulating unit 22 oppositely of the PTC component 21.

Figure 5:
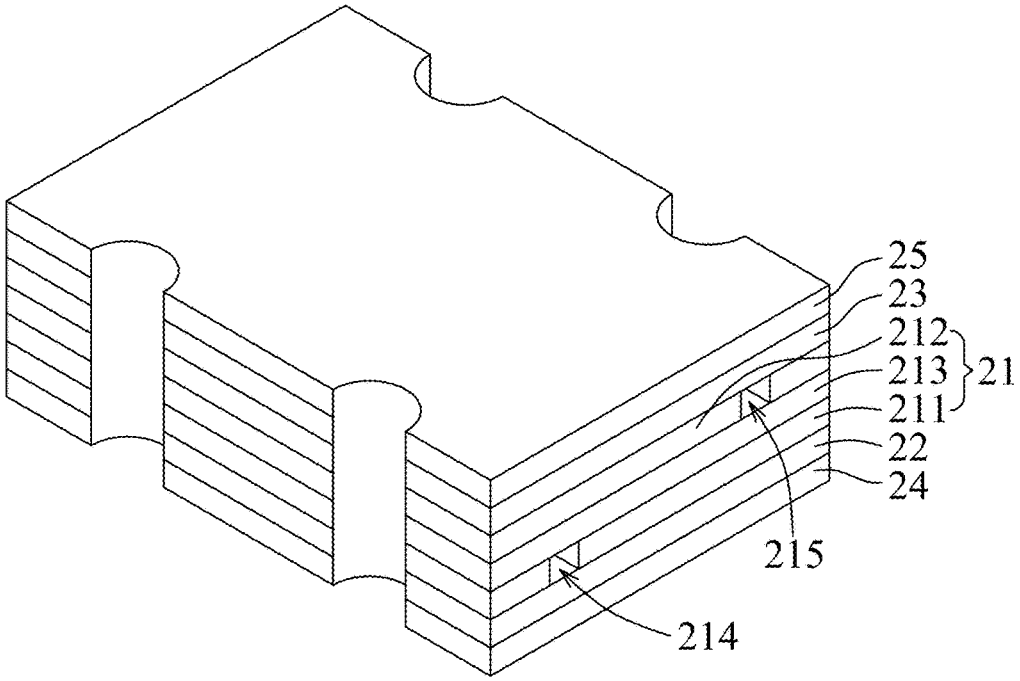

In Step S4, referring to FIG. 5, an upper electrode component 25 is disposed on the second insulating unit 23 oppositely of the PTC component 21.

In this embodiment, each of the lower and upper electrode components 24, 25 is nickel clad copper foil.

Figure 6:
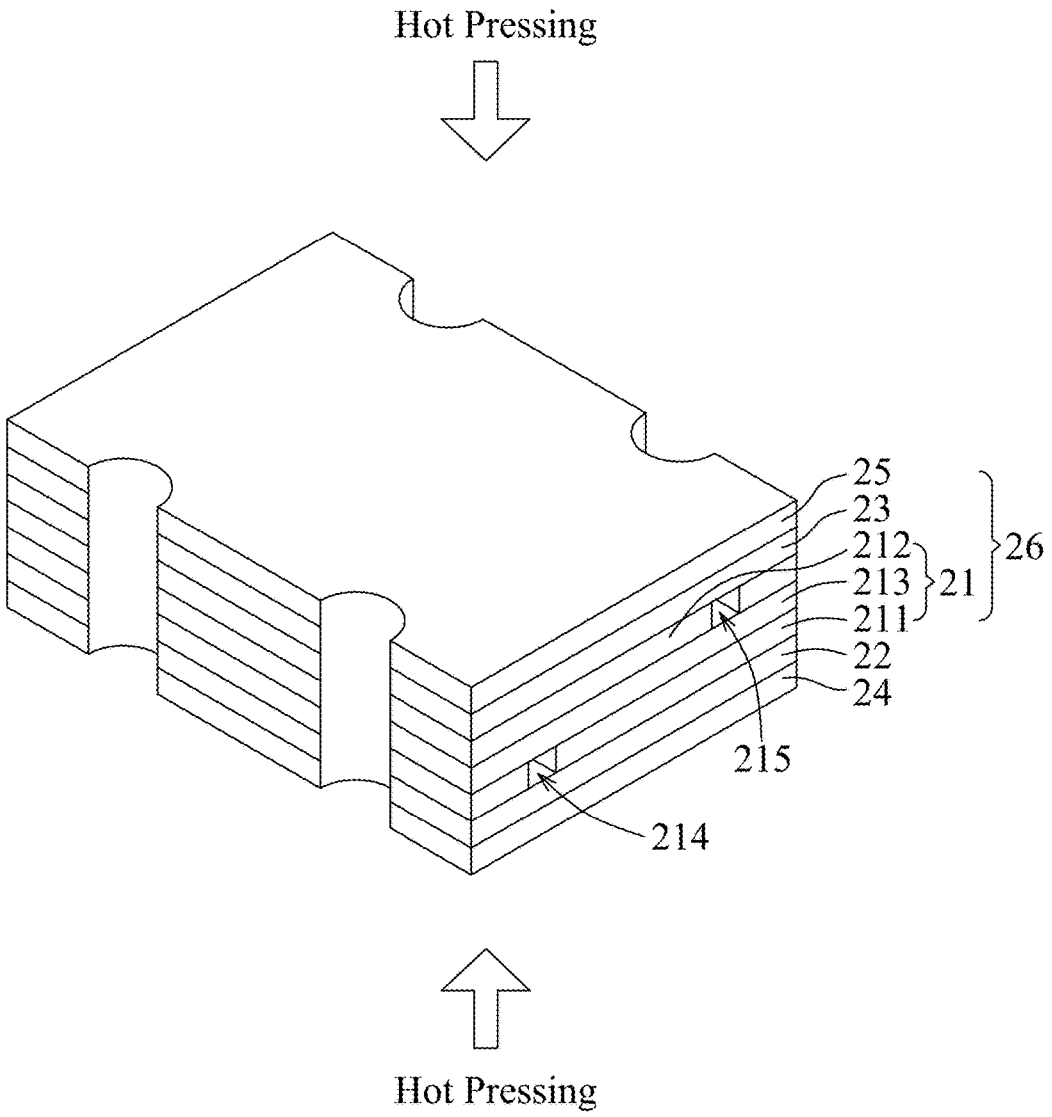

In Step S5, referring to FIG. 6, the PTC component 21, the first and second insulating units 22, 23, and the lower and upper electrode components 24, 25 are subjected to hot pressing. After the hot pressing, the PTC component 21, the second insulating unit 23 and the upper electrode component 25 constitute a laminate body 26.

Figure 7:
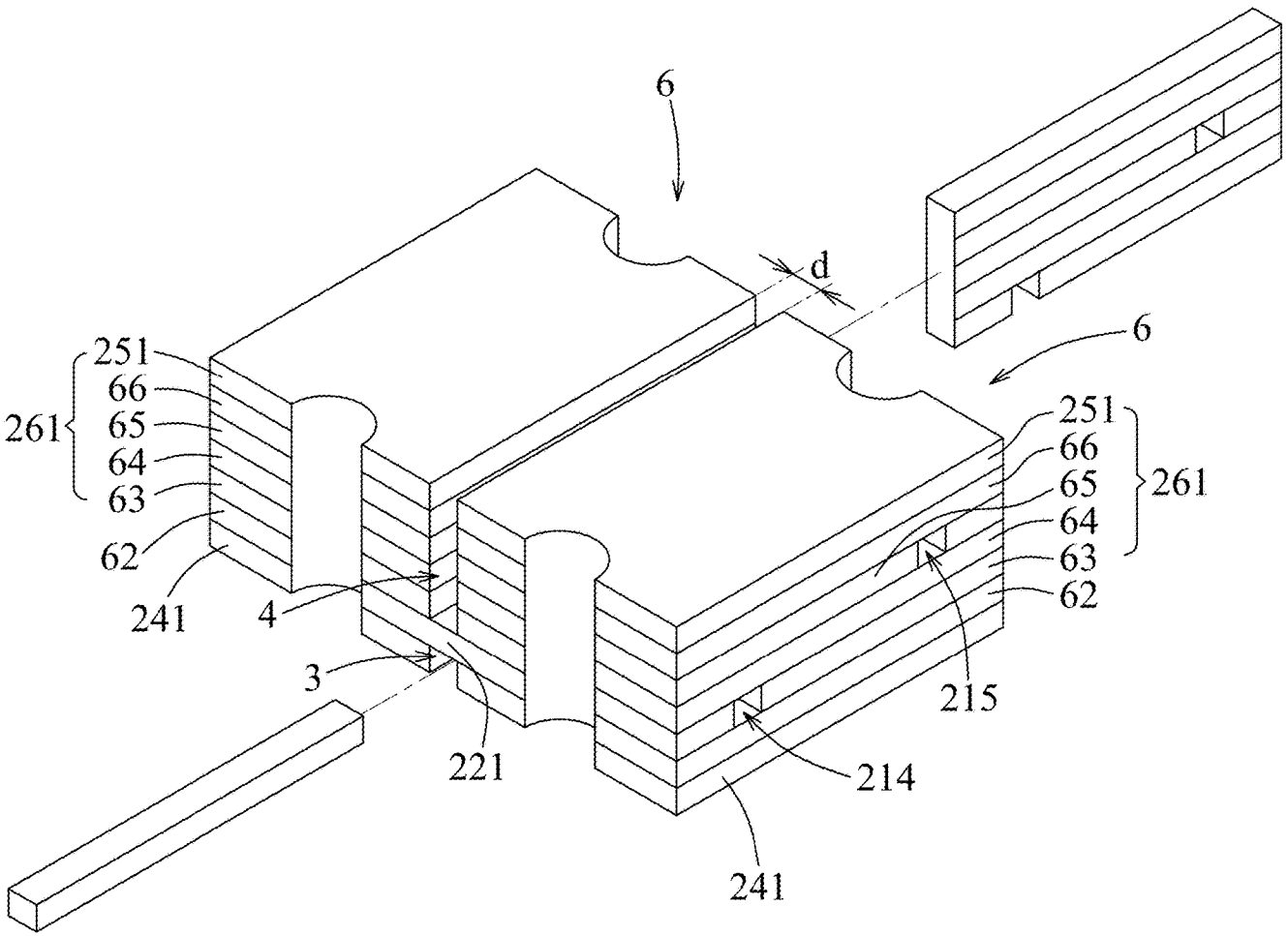

In Step S6, referring to FIG. 7, a first gap 3 is formed in the lower electrode component 24 such that the first insulating unit 22 is exposed from the first gap 3 and the lower electrode component 24 is divided into two separated lower electrode units 241, and a second gap 4 is formed in the laminate body 26 such that the laminate body 26 is divided into two separated laminating units 261, so as to form two interconnected PTC units 6 each of which includes one of the lower electrode units 241, one of the laminating units 261, and apart of the first insulating unit 22. Specifically, the first insulating unit 22 includes two first insulating layers 62 (i.e., the part of the first insulating unit 22 mentioned above) and an insulating bridge layer 221 interconnecting the two first insulating layers 62. As shown in FIGS. 6 and 7, in step S6 of forming the second gap 4 in the laminate body 26, the first electrically conductive unit 211 is divided into two separated first electrically conductive layers 63, the second electrically conductive unit 212 is divided into two separated second electrically conductive layers 65, and the PTC polymeric material unit 213 is divided into two separated PTC polymeric layers 64. The second insulating unit 23 is divided into two separated second insulating layers 66, and the upper electrode component 25 is divided into two separated upper electrode units 251. Each of the laminating units 261 includes one of the first electrically conductive layers 63, one of the second electrically conductive layers 65, one of the PTC polymeric layers 64, one of the second insulating layers 66, and one of the upper electrode units 251.

Figure 8:
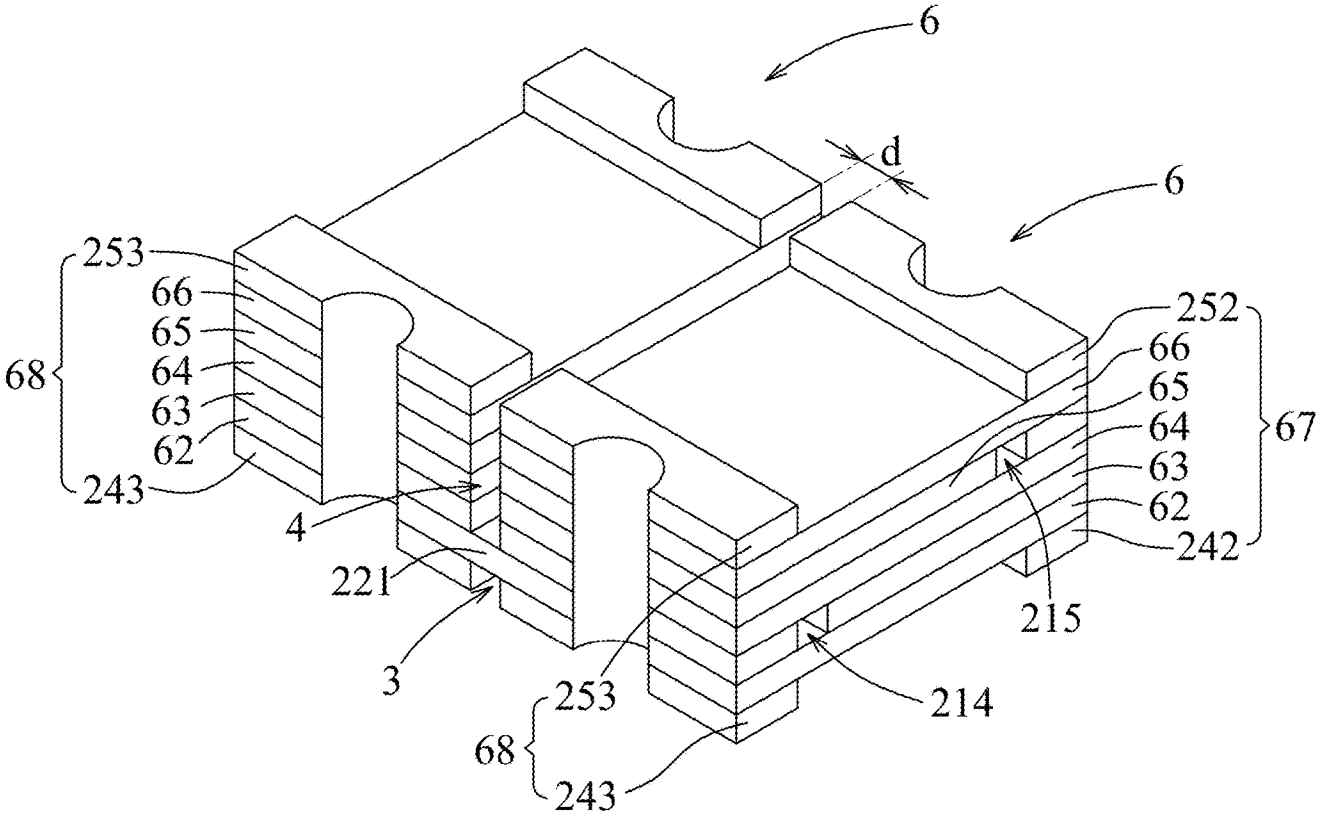
Figure 9:
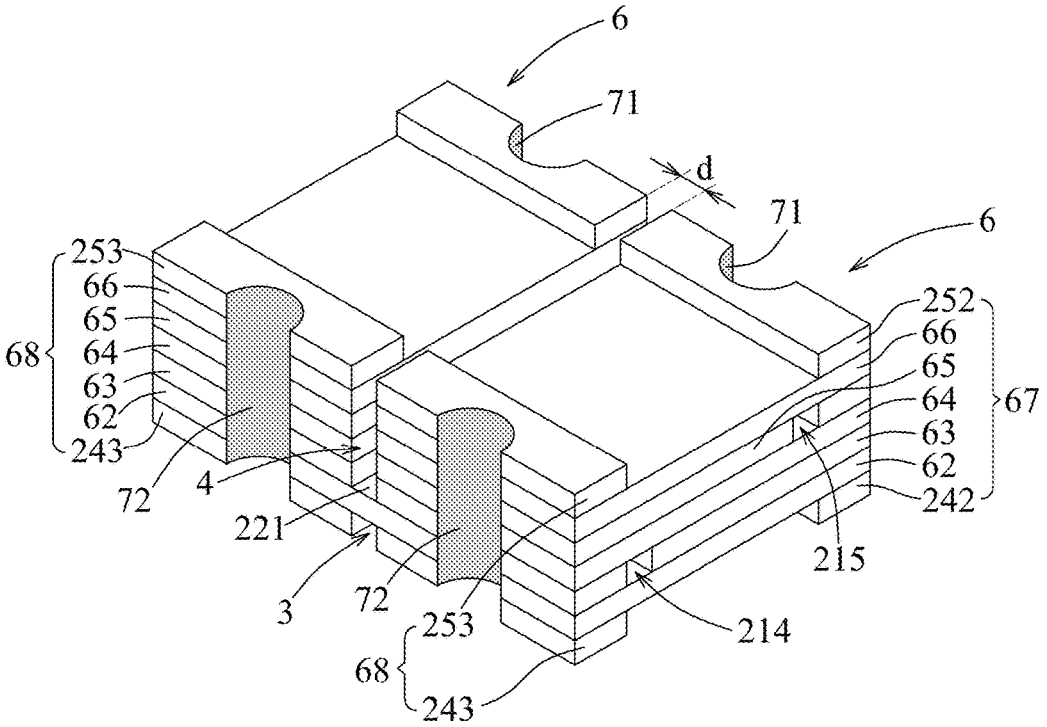

In step S7, as shown in FIG. 8, in each of the PTC units 6, the upper electrode unit 251 is processed to form two separated first and second upper electrode portions 252, 253, and the lower electrode unit 241 is processed to form two separated first and second lower electrode portions 242, 243. Each of the upper and lower electrode units 251, 241 may be processed by removing a central portion thereof using an ordinary process, e.g., etching. The first upper electrode portion 252 and the first lower electrode portion 242 constitute a first electrode 67. The second upper electrode portions 253 and the second lower electrode portion 243 constitute a second electrode 68. In step S8, in each of the PTC units 6, the first electrode 67 is electrically connected to the first electrically conductive layer 63, and electrically insulated from the second electrically conductive layer 65. The second electrode 68 is electrically connected to the second electrically conductive layers 65, and electrically insulated from the first electrically conductive layer 63. As shown in FIG. 9, in certain embodiments, the electrical connection is achieved by forming first and second electrically conductive connecting members 71, 72 on two opposite sides of each of the PTC units 6. In this embodiment, each of the electrically conductive connecting members 71, 72 may be a semi-circular hole coated with a conductive metal layer, such as a copper or gold layer by electroless-plating or electroplating. In addition to semi-circular shape, the cross-sections of the conductive holes may be independently of quarterly-circular, arc, square, diamond, rectangular, triangular or polygonal shape.

In certain embodiments, the second gap 4 has a minimum width (d) that is greater than or equal to 0.1 mm. In certain embodiments, the minimum width of the second gap 4 ranges from 0.1 to 0.7 mm.

In this embodiment, the PTC polymeric material unit 213 includes a polymer matrix and a particulate conductive filler dispersed in the polymer matrix. The polymer matrix includes a non-grafted olefin-based polymer (such as high density polyethylene, HDPE). In this embodiment, the polymer matrix further includes a carboxylic acid anhydride-grafted olefin-based polymer. The carboxylic acid anhydride-grafted olefin-based polymer may be carboxylic acid anhydride-grafted high density polyethylene. In this embodiment, the carboxylic acid anhydride-grafted olefin-based polymer is maleic anhydride-grafted high density polyethylene.

In certain embodiments, the polymer matrix may be in an amount ranging from 5 wt % to 50 wt % based on the weight of the PTC polymeric material unit 213, and the particulate conductive filler may be in an amount ranging from 50 wt % to 95 wt % based on the weight of the PTC polymeric material unit 213.

In this disclosure, the particulate conductive filler may be made from carbon black, metal, or an electrically conductive ceramic material.

The particulate conductive filler may include carbon black, titanium carbide, zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, tungsten disilicide, gold, silver, copper, aluminum, nickel, nickel-metallized glass beads, nickel-metallized graphite, Ti—Ta solid solution, W—Ti—Ta—Cr solid solution, W—Ta solid solution, W—Ti—Ta—Nb solid solution, W—Ti—Ta solid solution, W—Ti solid solution, or Ta—Nb solid solution.

In this embodiment, the insulating bridge layer 221 and this first insulating layers 62 are integrally formed as a one piece.

Steps S6, S7 and S8 are conducted after step S5 of hot pressing, and, in this embodiment, Steps S6, S7 and S8 are sequentially performed in such order. However, it should be noted that, the sequence for performing S6, S7 and S8 is not limited to the aforesaid, and may change based on actual requirements. For examples, step S7 may be performed before step S6, step S8 may be performed before step S6 or S7.

As shown in FIG. 9, the PTC circuit protection device made by the first embodiment of the method of this disclosure includes the two PTC units 6, the insulating bridge layer 221, and the first and second gaps 3,4. Each of the PTC units 6 includes the first insulating layer 62, the first electrically conductive layer 63 stacked on the first insulating layer 62, the PTC polymeric layer 64 stacked on the first electrically conductive layer 63, the second electrically conductive layer 65 stacked on the PTC polymeric layer 64, the second insulating layer 66 stacked on the second electrically conductive layer 65, the first electrode 67 electrically connected to the first electrically conductive layer 63 and electrically insulated from the second electrically conductive layer 65, the second electrode 68 electrically connected to the second electrically conductive layer 65 and electrically insulated from the first electrically conductive layer 63; an insulating bridge layer 221 interconnecting the first insulating layers 62 of the PTC units 6; and first and second gaps 3,4 formed between the PTC units 6 and located at two opposite sides of the insulating bridge layer 221.

In certain embodiments, step S7 of processing the upper and lower electrode units 241, 251 may be omitted. In such case, the lower and upper electrode units 241, 251 are respectively used as the first and second electrodes 67, 68, the conductive metal layer of the first electrically conductive connecting member 71 is formed on a part (e.g., a lower part) of the semi-circular hole such that the first electrode 67 (i.e., the lower electrode unit 241) is electrically connected to the first electrically conductive layer and electrically insulated from the second electrically conductive layer 65, and the conductive metal layer of the second electrically conductive connecting member 72 is formed on apart (e.g., an upper part) of the semi-circular hole such that the second electrode 68 (i.e., upper electrode unit 251) is electrically connected to the second electrically conductive layer 65 and electrically insulated from the second electrically conductive layer 63.

Figure 10:
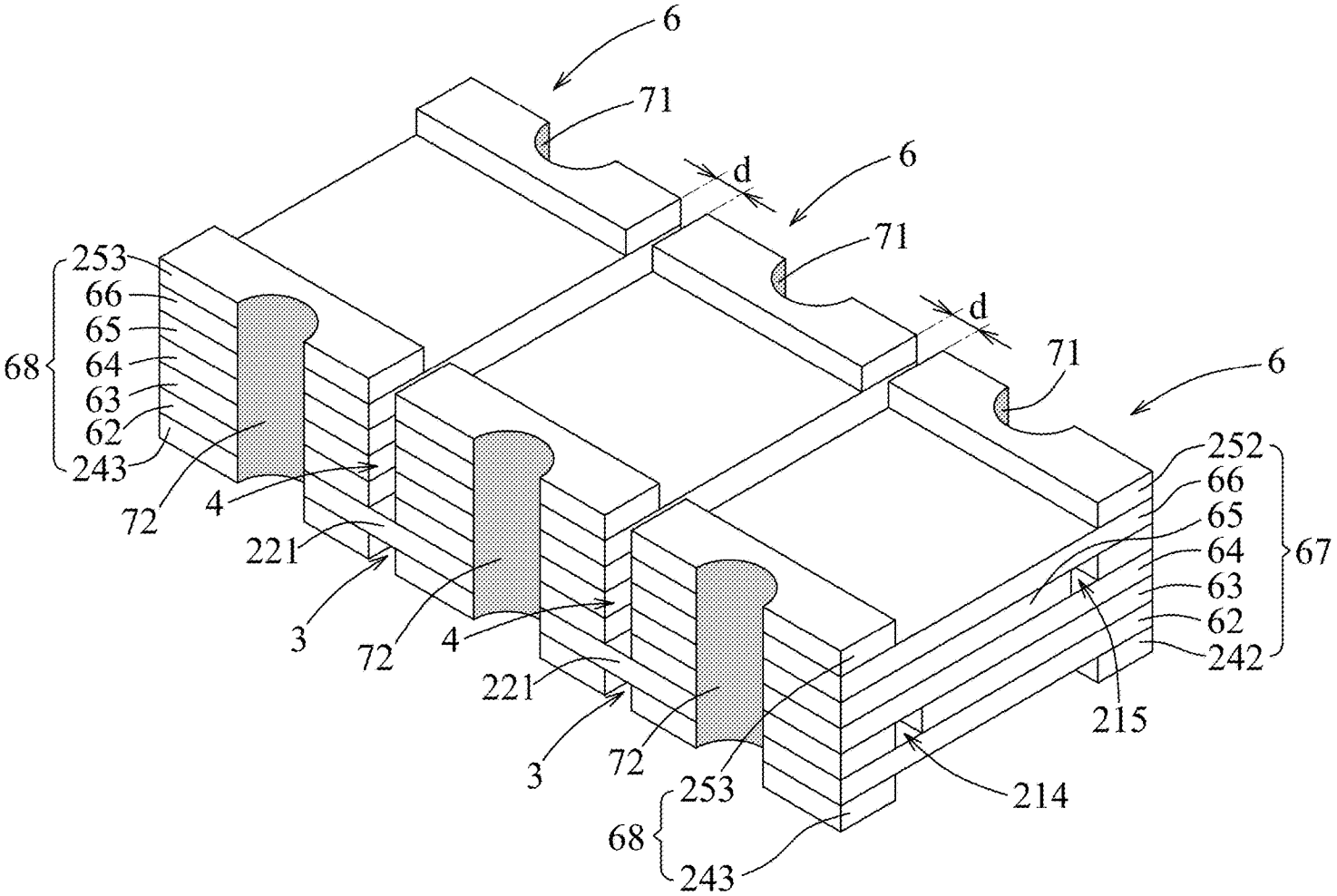
FIG. 10 is a perspective view of the second embodiment of a PTC circuit protection device according to this disclosure.

FIG. 10 illustrates the second embodiment of a PTC circuit protection device according to this disclosure. The second embodiment is similar to the first embodiment, except that the PTC circuit protection device of this embodiment includes three of the PTC units 6 and two of the insulating bridge layers 221 each interconnecting the first insulating layers 62 of the respective two adjoining PTC units 6. Among the three PTC units, the first and second gaps 3,4 are formed between each two adjoining ones of the PTC units 6, and located at two opposite sides of each of the insulating bridge layers 221.

The disclosure will be further described by way of the following examples and comparative example. However, it should be understood that the following examples and comparative example are solely intended for the purpose of illustration and should not be construed as limiting the disclosure in practice.

EXAMPLE

Example 1 (E1)

10.5 grams of HDPE (purchased from *Formosa* plastic Corp., catalog no.: HDPE9002) serving as the non-grafted olefin-based polymer, 10.5 grams of maleic anhydride grafted olefin-based polymer (purchased from Dupont, catalog no.: MB100D) serving as the carboxylic acid anhydride-grafted olefin-based polymer, 29 grams of carbon black particles (trade name: Raven 430UB, commercially available from Columbian Chemicals Company) serving as the particulate conductive filler were compounded in a Brabender mixer. The compounding temperature was 200° C., the stirring rate was 50 rpm, the applied pressure was 5 Kg, and the compounding time was 10 minutes. The compounded mixture was extruded to form pellets of a PTC polymer material.

The pellets were sandwiched between first and second nickel-plated copper foil films so as to form a stack. The stack was hot pressed so as to form a PTC component 21. The hot pressing temperature was 200° C., the hot pressing time was 4 minutes, and the hot pressing pressure was 80 $kg/cm^2$.

The PTC component 21 was then irradiated by a cobalt-60 source for a total radiation dose of 15 Mrad.

Two grooves 214, 215 were respectively formed in the first and second nickel-plated copper foil films by chemical etching, such that the PTC polymeric material unit 213 is exposed from the grooves 214, 215 and each of the first and second conductive films is divided into two separated portions. One of the portions of the first conductive film was used as the first electrically conductive unit 211. Similarly, one of the portions of the second conductive film was used as the second electrically conductive unit 212.

First and second insulating units 22, 23 (made from epoxy resin) were respectively disposed on the first and second electrically conductive units 211, 212 of the PTC component 21.

A lower electrode component 24 of a nickel-plated copper foil sheet (having a thickness of 0.35 mm) was disposed on the first insulating unit 22 oppositely of the PTC component 21, and an upper electrode component of a nickel-plated copper foil sheet (having a thickness of 0.35 mm) was disposed on the second insulating unit 23 oppositely of the PTC component 21. The stack of PTC component 21, the first and second insulating units 22, 23, and the lower and upper electrode components 24, 25 were hot pressed. The PTC component 21, the second insulating unit 23 and the electrode component 25 constituted a laminate body 26.

A first gap 3 was formed in the lower electrode component 24 such that the first insulating unit 22 was exposed from the first gap 3 and the lower electrode component 24 was divided into two separated lower electrode units 241. A second gap 4 was formed in the laminate body 26 such that the laminate body 26 is divided into two separated laminating units 261, so as to form two interconnected PTC units 6. Each of the PCT units 6 includes one of the lower electrode units 241, one of the laminating units 261 and a part of the first insulating unit 22. Each of the first gap 3 and the second gap 4 had a minimum width (d) of 0.1 mm.

In each of the PTC units 6, a central portion of the lower electrode unit 241 was removed so as to form two separated first and second lower electrode portions 242, 243, and a central portion of the upper electrode unit 251 was removed so as to form two separated first and second upper electrode portions 252, 253. The first upper electrode portion 252 and the first lower electrode portion 242 constituted a first electrode 67, and the second upper electrode portions 253 and the second lower electrode portion 243 constituted a second electrode 68. Two semi-circular conductive holes coated with metal layers (serving as first and second electrically conductive connecting members 71, 72) were formed on two opposite sides of the PTC unit 6. Thus, the first electrode 67 was electrically connected to the first electrically conductive layer 63 through the first electrically conductive connecting members and electrically insulated from the second electrically conductive layer 65. The second electrode was electrically connected to the second electrically conductive layer 65 through the second electrically conductive connecting members 72 and electrically insulated from the first electrically conductive layer 63. A PTC circuit protection device including the two interconnected PTC units 6 was thus obtained. The resistance of each of the PTC units 6 of Example 1 are shown in Table 1.

Examples 2-3 (E2 and E3)

The procedures and conditions in preparing PTC circuit protection devices of Examples 2-3 (E2 and E3) were similar to those of Example 1, except that each of the first and second gaps 3, 4 of Example 2 has a diameter of 0.35 mm, and each of the first and second gaps 3, 4 of Example 3 has a diameter of 0.7 mm. The electrical properties of the PTC circuit protection device of Examples 2-3 were determined, and the results are shown in Table 1.

Comparative Example (CE)

Figure 11:
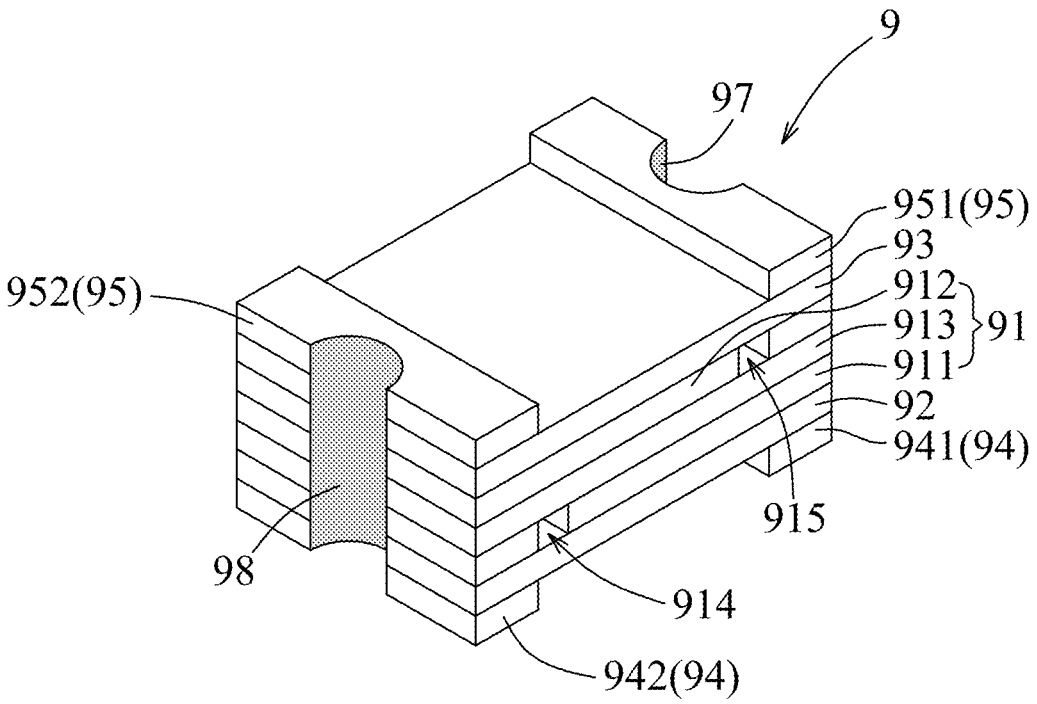
FIG. 11 is a perspective view of Comparative Example of a PTC circuit protection device.

FIG. 11 illustrates Comparative Example of a PTC circuit protection device that has only one PTC unit 9. The PTC unit 9 of Comparative Example has a size the same as that of one of the PTC units 6 of Example 1. Preparation of the PTC circuit protection device of the Comparative Example was described as follows.

5.25 grams of HDPE (purchased from *Formosa* plastic Corp., catalog no.: HDPE9002) serving as the non-grafted olefin-based polymer, 5.25 grams of maleic anhydride grafted olefin-based polymer (purchased from Dupont, catalog no.: MB100D) serving as the carboxylic acid anhydride-grafted olefin-based polymer, 14.5 grams of carbon black particles (trade name: Raven 430UB, commercially available from Columbian Chemicals Company) serving as the particulate conductive filler were compounded in a Brabender mixer. The compounding temperature was 200° C., the stirring rate was 50 rpm, the applied pressure was 5 Kg, and the compounding time was 10 minutes. The compounded mixture was extruded to form pellets of a PTC polymer material.

The pellets were sandwiched between first and second nickel-plated copper foil films so as to form a stack. The stack was hot pressed so as to form a PTC component 91. The hot pressing temperature was 200° C., the hot pressing time was 4 minutes, and the hot pressing pressure was 80 $kg/cm^2$.

The PTC component 91 was then irradiated by a cobalt-60 source for a total radiation dose of 15 Mrad.

Two grooves 914, 915 were respectively formed in the first and nickel-plated copper foil films by chemical etching, such that the PTC polymeric material unit 913 is exposed from the grooves 914, 915, and each of the first and second conductive films is divided into two separated portions. One of the portions of the first conductive film was used as the first electrically conductive unit 911. Similarly, one of the portions of the second conductive film was used as the second electrically conductive unit 912.

First and second insulating units 92, 93 (made from epoxy resin) were respectively disposed on the first and second electrically conductive units 911, 912 of the PTC component 91.

A lower electrode component 94 of a nickel-plated copper foil sheet (having a thickness of 0.35 mm) was disposed on the first insulating unit 92 oppositely of the PTC component 91, and an upper electrode component of a nickel-plated copper foil sheet (having a thickness of 0.35 mm) was disposed on the second insulating unit 93 oppositely of the PTC component 91. The stack of PTC component 91, the first and second insulating units 92, 93, and the lower and upper nickel-plated copper foil sheets 94, 95 were hot pressed so as to form the PTC unit 9.

A central portion of the lower electrode component 94 was removed so as to form two separated first and second lower electrode portions 941, 942. A central portion of the upper electrode component 95 was removed so as to form two separated first and second upper electrode portions 951, 952. The first upper electrode portion 951 and the first lower electrode portion 941 constituted a first electrode, and the second upper electrode portions 952 and the second lower electrode portion 942 constituted a second electrode. Two semi-circular conductive holes coated with metal layers (serving as first and second electrically conductive connecting members 97, 98) were formed on two opposite sides of the PTC unit 9. Thus, the first electrode was electrically connected to the first electrically conductive unit 911 through the first electrically conductive connecting members 97 and electrically insulated from the second electrically conductive unit 912. The second electrode was electrically connected to the second electrically conductive unit 912 through the second electrically conductive connecting members 98 and electrically insulated from the first electrically conductive unit 911. The resistance of the PTC circuit protection device of Comparative Example are shown in Table 1.

TABLE 1

| | Width of each gaps (mm) | Resistance of one of the PTC units (Ri, ohm) | Resistance of the other one of the PTC units (Ri, ohm) |
|---|---|---|---|
| E 1 | 0.10 | 0.363 | 0.363 |
| E 2 | 0.35 | 0.364 | 0.363 |
| E 3 | 0.70 | 0.362 | 0.364 |
| CE | — | 0.364 | — |

<Performance Test>

Hold Current Test

Ten test samples of the PTC circuit protection device of each of Examples 1-3 and Comparative Example were subjected to trip test for determining the surface temperature of the PTC unit(s) in each of the test samples and for finding whether the PTC unit(s) can endure for 15 minutes without tripping.

The trip test was conducted under a fixed DC voltage of 16V of and a current of 0.75 A. The test results are shown in Table 2.

TABLE 2

| | One of the PTC units | | The other of the PTC units | |
|---|---|---|---|---|
| | Surface temperature (□) | Tripped | Surface temperature (□) | Tripped |
| E 1 | 35.2 | No | 35.5 | No |
| E 2 | 35.0 | No | 35.2 | No |
| E 3 | 35.2 | No | 35.0 | No |
| CE1 | 36.1 | No | — | — |

Trip Current Test

In this experiment, one of the PTC units of the PTC circuit protection device in each of E1 to E3 was tripped, and the surface temperature of each of the PTC units and the current of the other of the PTC units of the PTC circuit protection device in each of E1 to E3 was determined. The surface temperature in Comparative Example was also measured. The experiment was conducted under a fixed DC voltage of 16V and a current of 1.5 A. Ten test samples of the device of each of E1 to E3 and CE were subjected to such experiment, and the average thereof are calculated and listed in Table 3.

TABLE 3

| | One of the PTC units | | The other of PTC units | |
|---|---|---|---|---|
| | Surface temperature (□) | Tripped | Surface temperature (□) | Current (A) |
| E 1 | 110.5 | Yes | 38.8 | 0.75 |
| E 2 | 109.8 | Yes | 37.4 | 0.75 |
| E 3 | 110.6 | Yes | 36.9 | 0.75 |
| CE1 | 110.1 | Yes | — | — |

It is shown from Table 1 and Table 2 that the PTC units 6 of PTC circuit protection devices of Examples 1-3 and Comparative Example have similar resistance property, and may withstand the current of 0.75 A for 15 minutes without tripping. Table 3 shows that, in the PTC circuit protection device of each of Examples 1-3, when one of the PTC units 6 was tripped, the other of the PTC units maintained its function properly, and has low surface temperature (about 36° C. to 39° C.). In contrast, since the PTC circuit protection device of Comparative Example has only one PTC unit 9, after the PTC unit 9 was tripped, the PTC circuit protection device cannot be operated until the PTC unit 9 is reset.

In conclusion, by virtue of the method of this disclosure, the PTC circuit protection device with two connected PTC units may be obtained. When one of the PTC units is tripped, the other of the PTC units may still provide the desired PTC property.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A PTC circuit protection device, comprising:

two PTC units, each of said PTC units including a first insulating layer, a first electrically conductive layer stacked on said first insulating layer, a PTC polymeric layer stacked on said first electrically conductive layer, a second electrically conductive layer stacked on said PTC polymeric layer, a second insulating layer stacked on said second electrically conductive layer, a first electrode electrically connected to said first electrically conductive layer and electrically insulated from said second electrically conductive layer, a second electrode electrically connected to said second electrically conductive layer and electrically insulated from said first electrically conductive layer;

an insulating bridge layer interconnecting said first insulating layers of said PTC units; and first and second gaps formed between said PTC units and located at two opposite sides of said insulating bridge layer.

2. The PTC circuit protection device of claim 1, wherein said insulating bridge layer and said first insulating layers are integrally formed as a one piece.

3. A method of making a PTC circuit protection device, comprising:

providing a PTC component that includes a first electrically conductive unit, a second electrically conductive unit and a PTC polymeric material unit sandwiched between the first and second electrically conductive units, disposing a first insulating unit on the first electrically conductive unit of the PTC component, and disposing a second insulating unit on the second electrically conductive unit of the PTC component;

disposing a lower electrode component on the first insulating unit oppositely of the PTC component;

disposing an upper electrode component on the second insulating unit oppositely of the PTC component;

hot pressing the PTC component, the first and second insulating units, and the lower and upper electrode components, wherein the PTC component, the second insulating unit and the upper electrode component constituting a laminate body;

forming a first gap in the lower electrode component such that the lower electrode component is divided into two separated lower electrode units, and forming a second gap in the laminate body such that the laminate body is divided into two separated laminating units, so as to form two interconnected PTC units each of which includes one of the lower electrode units, one of the laminating units, and a part of the first insulating unit 22.

4. The method of claim 3, wherein in the step of forming the second gap in the laminate body, the first electrically conductive unit is divided into two separated first electrically conductive layers, the second electrically conductive unit is divided into two separated second electrically conductive layers, the PTC polymeric material unit is divided into two separated PTC polymeric layers, the second insulating unit is divided into two separated second insulating layers, and the upper electrode component is divided into two separated upper electrode units, each of the laminating units including one of the first electrically conductive layers, one of the second electrically conductive layers, one of the PTC polymeric layers, one of the second insulating layers, and one of the upper electrode units.

5. The method of claim 4, further comprising, in each of the PTC units, processing the one of the upper electrode units to form separated first and second upper electrode portions, and processing the one of the lower electrode unit to form separated first and second lower electrode portions, the first upper electrode portion and the first lower electrode portion constituting a first electrode, the second upper electrode portions and the second lower electrode portion constituting a second electrode.

6. The method of claim 5, further comprising, in each of the PTC units, electrically connecting the first electrode to the one of the first electrically conductive layer and electrically insulated from the one of the second electrically conductive layer, and electrically connecting the second electrode to the one of the second electrically conductive layer and electrically insulated from the one of the first electrically conductive layer.

7. The method of claim 3, wherein the second gap has a minimum width that is greater than or equal to 0.1 mm.

8. The method of claim 7, wherein the minimum width of the second gap ranges from 0.1 to 0.7 mm.

9. The method of claim 3, wherein the PTC polymeric material unit includes a polymer matrix and a particulate conductive filler dispersed in the polymer matrix, the polymer matrix including a non-grafted olefin-based polymer.

10. The method of claim 9, wherein the polymer matrix further includes a carboxylic acid anhydride-grafted olefin-based polymer.

11. The method of claim 9, wherein the particulate conductive filler is selected from the group consisting of carbon black, metal, an electrically conductive ceramic material, and combinations thereof.

12. The method of claim 3, wherein each of the first electrically conductive unit and the second electrically conductive unit is nickel clad copper foil.

13. The method of claim 3, wherein each of the first insulating unit and the second insulating unit is made from epoxy resin.

* * * * *